US005740706A

United States Patent [19]

Tseng

[11] Patent Number: 5,740,706

[45] Date of Patent: Apr. 21, 1998

[54] TOOL HANDLE WITH CONCEALED STORAGE MEANS

[76] Inventor: Sen Piao Tseng, P. O. Box 82-144, Taipei, Taiwan

[21] Appl. No.: 725,305

[22] Filed: Oct. 2, 1996

[51] Int. Cl.[6] ..... B25G 1/08

[52] U.S. Cl. ..... 81/490; 81/177.4

[58] Field of Search ..... 81/177.4, 439, 81/490

[56] References Cited

U.S. PATENT DOCUMENTS

| | | | |
|---|---|---|---|
| 4,924,733 | 5/1990 | McKenzie | 81/490 X |
| 5,174,178 | 12/1992 | Disston | 81/490 |
| 5,265,504 | 11/1993 | Fruhm | 81/490 X |

*Primary Examiner*—James G. Smith
*Attorney, Agent, or Firm*—A & J

[57] ABSTRACT

A tool handle including a handle body having a backwardly opened receiving chamber and longitudinally disposed peripheral opening, a rotary storage wheel mounted in the receiving chamber and having longitudinal storage grooves spaced around the periphery for holding tool bits and accessories, and a rotary knob fastened to the rotary storage wheel and disposed outside the handle body and adapted for turning the rotary storage wheel to move the longitudinal storage grooves into alignment with the longitudinal opening of the handle body alternatively for loading/unloading tool bits and accessories.

1 Claim, 11 Drawing Sheets

TOOL HANDLE WITH CONCEALED STORAGE MEANS

BACKGROUND OF THE INVENTION

1. Field of the Invention

This invention relates to tool handles, and relates more particularly to such a tool handle which has concealed storage means adapted for holding different tool bits and accessories.

2. Description of the Prior Art

Various tool handles with storage means for holding tool bits and accessories have been disclosed,. and have appeared on the market. Exemplars are seen in Chinese Patent Publication No. 132,604 as shown in FIG. 1 (which was selected from original FIGS. 2 and 6), Chinese Patent Publication No. 137,944 as shown in FIG. 2 (which was selected from original FIG. 4), Chinese Patent Publication No. 155,929 as shown in FIG. 3 (which was selected from original FIGS. 2 and 3), Chinese Patent Publication No. 160,244 as shown in FIG. 4 (which was selected from original FIG. 1), Chinese Patent Publication No. 208,866 as shown in FIG. 5 (which was selected from original FIGS. 2 and 3), Chinese Patent Publication No. 243,731 as shown in FIG. 6 (which was selected from original FIGS. 1 and 2). These tool handles commonly have a hollow handle body adapted for holding tool bits and accessories, and cover means adapted for sealing the hollow handle body. Because of the arrangement of the cover means, access to the stored items is not convenient.

SUMMARY OF THE INVENTION

This invention relates a tool handle which has concealed storage means adapted for holding different tool bits and accessories.

According to one aspect of the present invention, the tool handle comprises a handle body having a backwardly opened receiving chamber and longitudinally disposed peripheral opening, a rotary storage wheel mounted in the receiving chamber and having longitudinal storage grooves spaced around the periphery for holding tool bits and accessories, and a rotary knob fastened to the rotary storage wheel and disposed outside the handle body and adapted for turning the rotary storage wheel to move the longitudinal storage grooves into alignment with the longitudinal opening of the handle body alternatively for loading/unloading tool bits and accessories. According to another aspect of the present invention, the longitudinal storage grooves of the rotary storage wheel may be respectively divided into a plurality of vertical storage spaces for holding screwdriver bits, or horizontal storage spaces for holding sockets horizontally. According to still another aspect of the present invention, indication marks are marked on the rear end of the handle body around the rotary knob and an index is marked on the rotary knob, so that the rotary storage wheel can be quickly turned to move the desired storage items to the longitudinal opening of the handle body for use.

DETAILED DESCRIPTION OF THE PREFERRED EMBODIMENT

Figure 1A:
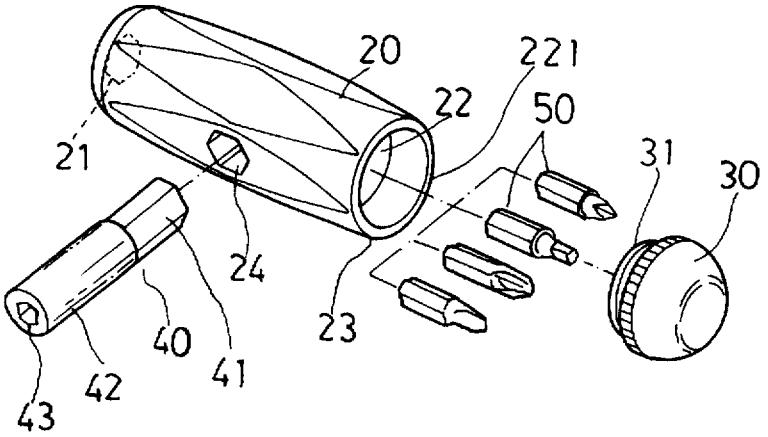
FIG. 1 shows the drawings selected from FIGS. 2 and 6 of Chinese Patent Publication No. 132,604.
Figure 1:
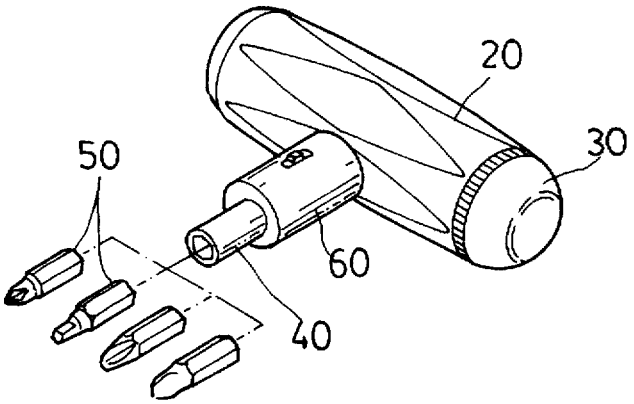
PRIOR ART FIG. 1
Figure 2:
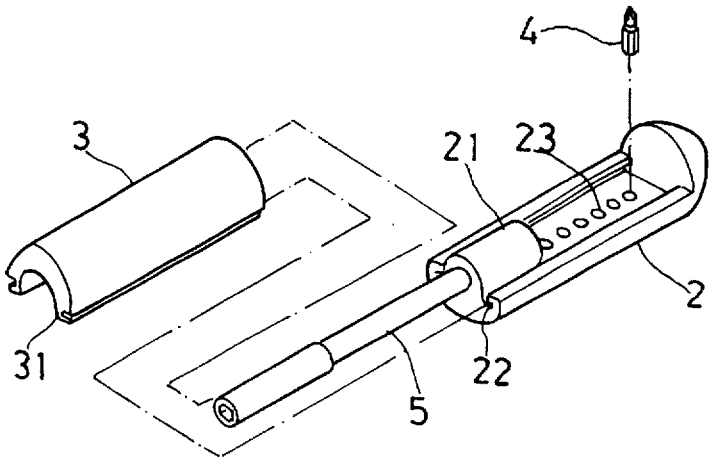
PRIOR ART FIG. 2
FIG. 2 shows a drawing selected from FIG. 4 of Chinese Patent Publication No. 137,944.
Figure 3A:
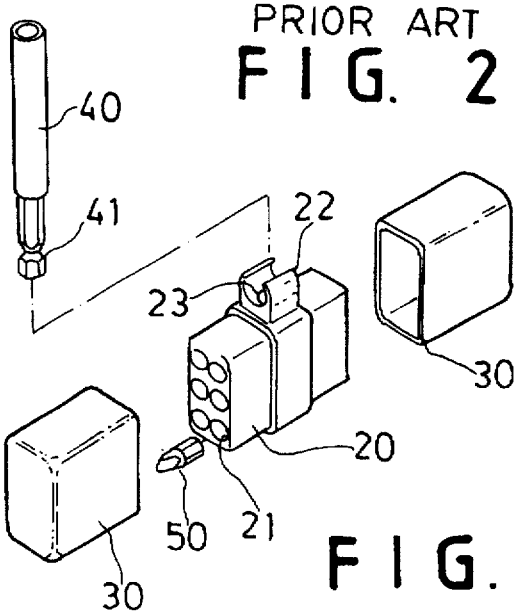
FIG. 3 shows two drawings selected from FIGS. 2 and 3 of Chinese/Patent Publication No. 155,929.
Figure 3:
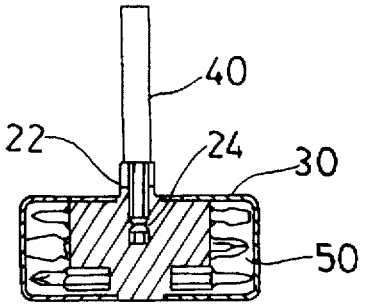
PRIOR ART FIG. 3
Figure 4:
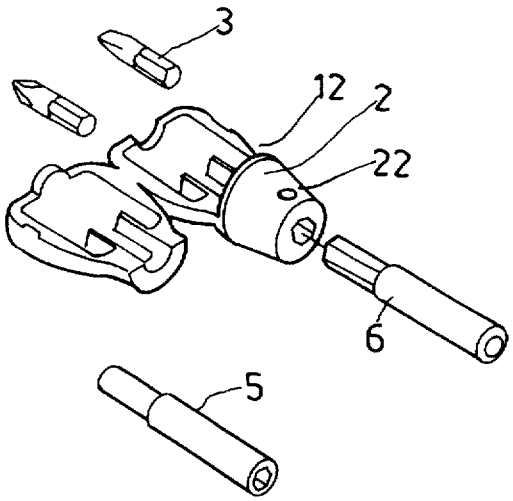
PRIOR ART FIG. 4
FIG. 4 shows a drawing selected from FIG. 1 of Chinese Patent Publication No. 160,244.
Figure 5A:
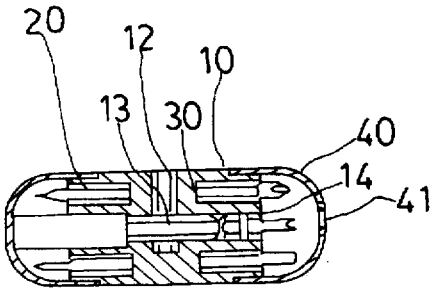
FIG. 5 shows two drawings selected from FIGS. 2 and 3 of Chinese Patent Publication No. 208,866.
Figure 5:
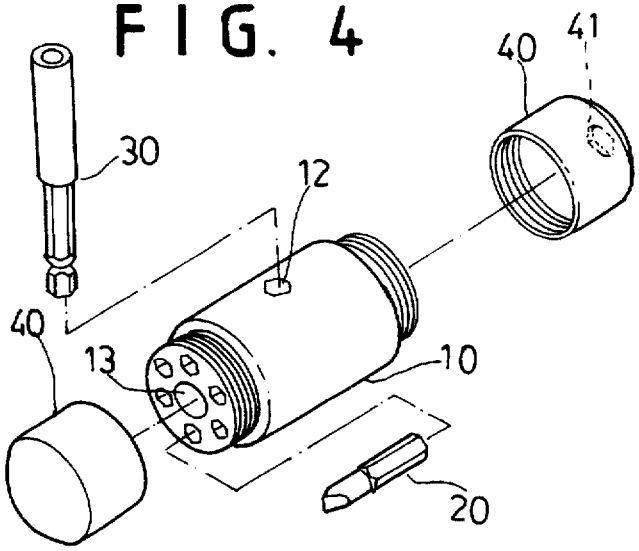
PRIOR ART FIG. 5
Figure 6A:
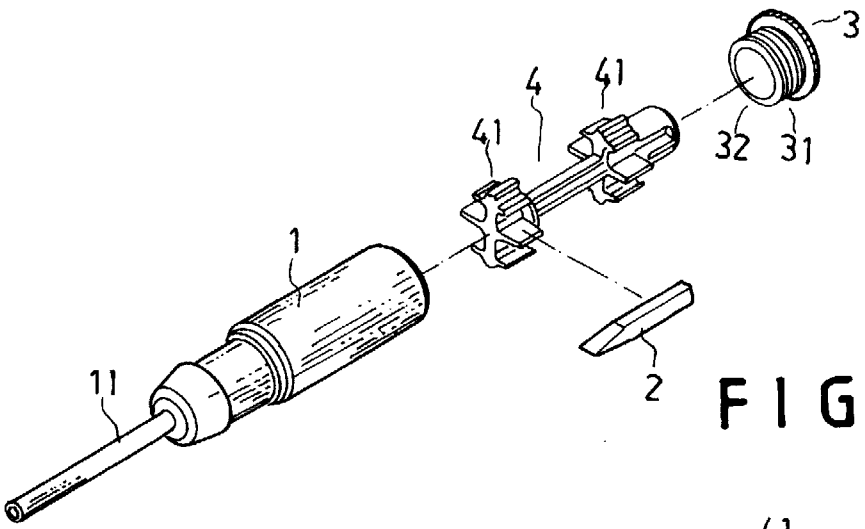
FIG. 6 shows two drawings selected from FIGS. 1 and 2 of Chinese Patent Publication No. 243,731.
Figure 6:
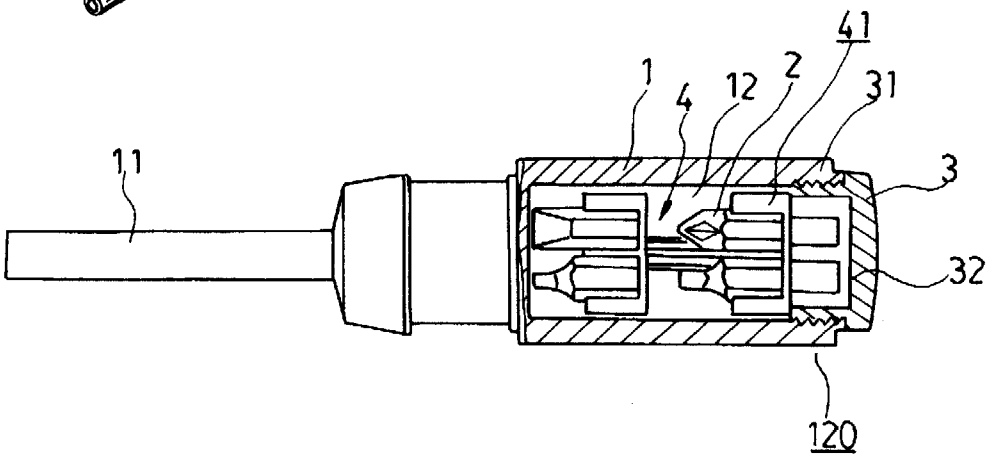
PRIOR ART FIG. 6

For the purpose of promoting an understanding of the principles of the invention, reference will now be made to the embodiment illustrated in the drawings. Specific language will be used to describe same. It will, nevertheless, be understood that no limitation of the scope of the invention is thereby intended, such alterations and further modifications in the illustrated device, and such further applications of the principles of the invention as illustrated herein being contemplated as would normally occur to one skilled in the art to which the invention relates.

Figure 7:
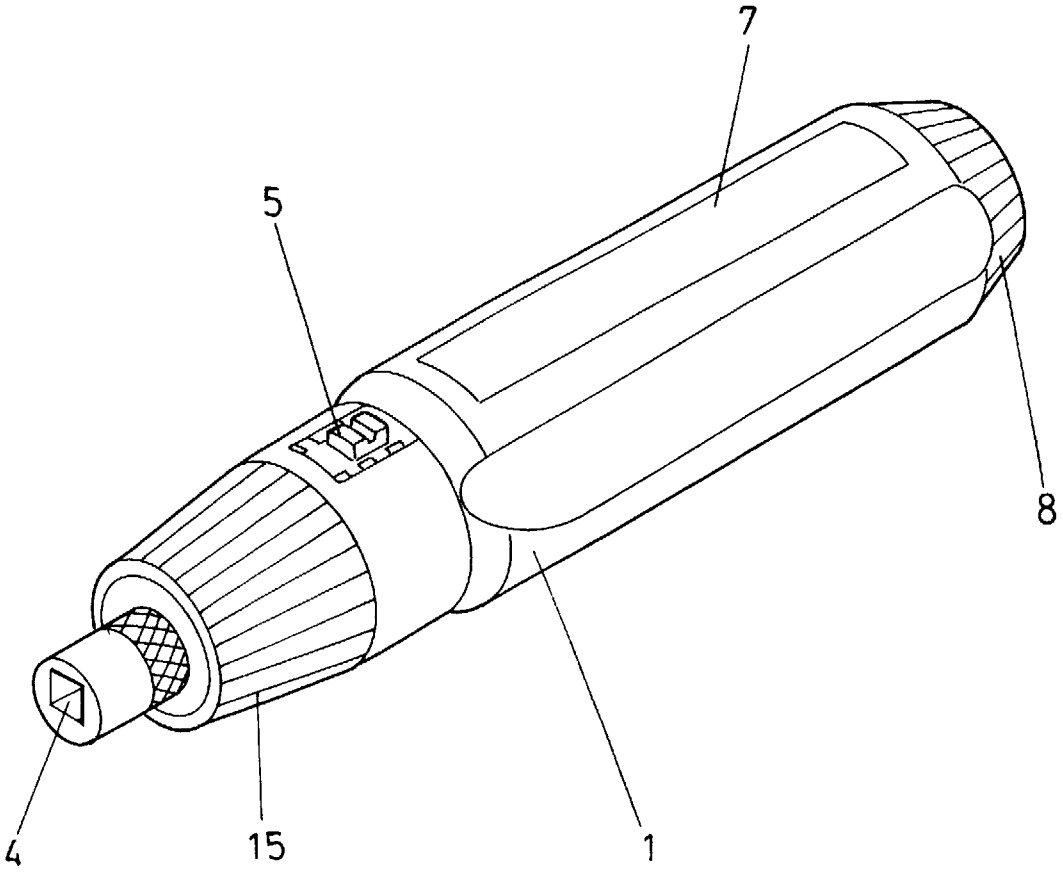
FIG. 7 is elevational view of a tool handle according to the present invention.
Figure 8:
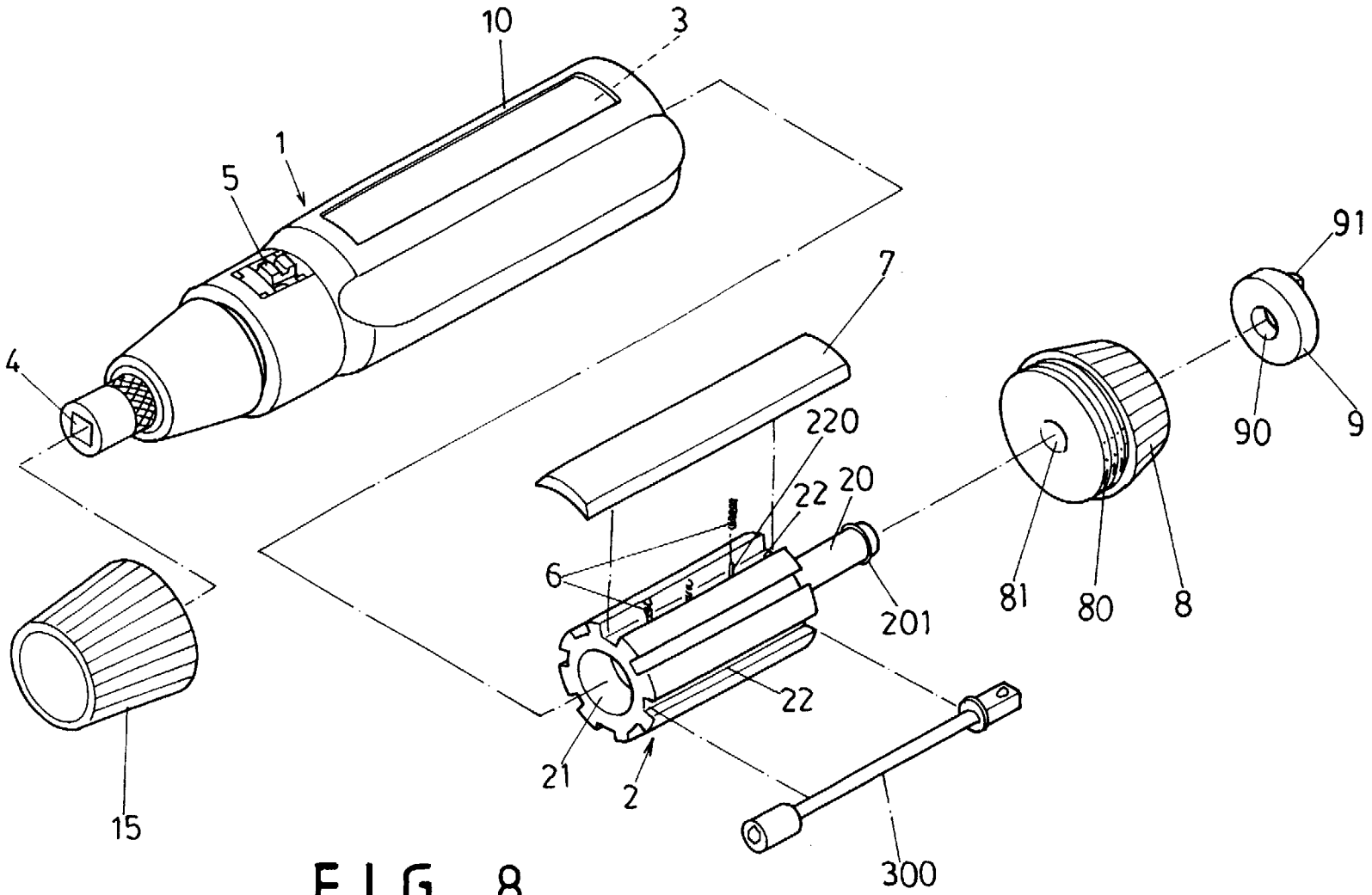
FIG. 8 is an exploded view of the tool handle shown in FIG. 7.

Referring to FIGS. 7 and 8, a tool handle in accordance with the present invention is generally comprised of an elongated, cylindrical handle body 1, and a rotary storage shaft 2. The handle body 1 comprises a backwardly opened receiving chamber 3 on the insider an axial shaft 30 inside the receiving chamber 3 (see also FIG. 9), a coupling 4 at the front side controlled by a ratchet mechanism control switch 5 for holding a bit 300 and turning it clockwise or counterclockwise, a shell 15 covered around the coupling 4, and a longitudinal opening 10 through the periphery in communication with the receiving chamber 3. The width of the longitudinal opening 10 is gradually increased from the outside toward the receiving chamber 3. The rotary storage wheel 2 comprises an axial wheel shaft 20 raised from one side, an axial coupling hole 21 disposed at an opposite side, a plurality of longitudinal storage grooves 22 spaced around the periphery, a longitudinal row of upright stub rods 220 in one longitudinal storage grooves 22, a plurality of tension springs 6 respectively mounted on the upright stub rods 220, and an elongated cover plate 7 supported on the tension springs 6. The elongated cover plate 7 has a substantially arched cross section, and a longitudinal row of downward stub rods 70 respectively connected to the tension springs 6. The tension springs 6 are respectively connected between the upright stub rods 220 and the downward stub rods 70 to support the cover plate 7 above the corresponding longitudinal storage groove 22, and the cover plate 7 can be forced downwards and closely attached to the periphery of the rotary storage wheel 2.

Figures 9, 9A, 9B:
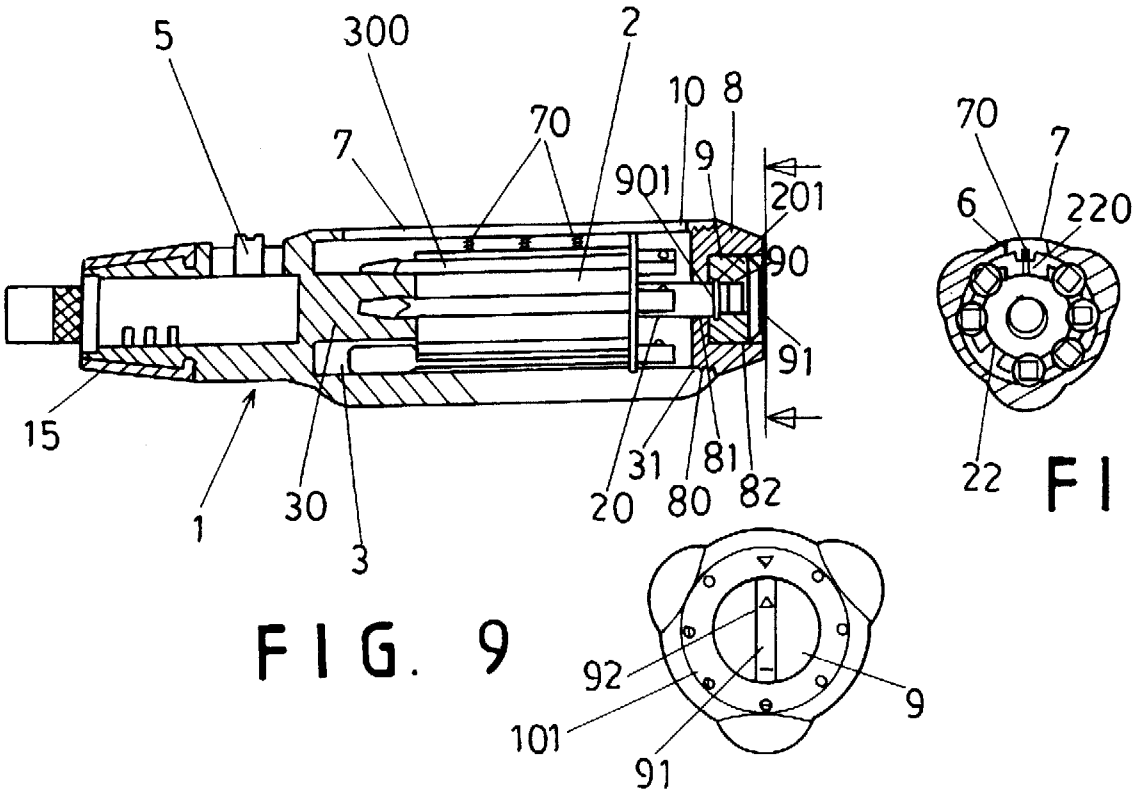
FIG. 9 is a sectional plain view of the tool handle shown in FIG. 1.
FIG. 9A is a rear end view of FIG. 9.
FIG. 9B is cross sectional view of FIG. 9.

Referring to FIGS. 9, 9A, and 9B, and FIG. 8 again, the rotary storage wheel 2 is inserted into the receiving chamber 3, and the axial coupling hole 21 of the rotary storage wheel 2 is coupled to the axial shaft 30 of the handle body 1, permitting the rotary storage wheel 2 to be turned on the axial shaft 30, and then a cap 8 is fastened to the rear end of the handle body 1 to close the receiving chamber 3. The cap 8 has an outer thread 80 threaded into an inner thread 31 in the rear open end of the receiving chamber 3, a recessed back chamber 82, and an axial center hole 81 through the center of the recessed back chamber 82. When the cap 8 is fastened to the handle body 1, the axial wheel shaft 20 of the rotary storage wheel 2 passes through the axial center hole 81 of the cap 8, and a rotary knob 9 is mounted within the recessed back chamber 82 and fastened to the axial wheel shaft 20 of the rotary storage wheel 2. The rotary knob 9 comprises a center coupling hole 90 fitting the axial wheel shaft 20 of the rotary storage wheel 2, a rib 91 raised from the outer side at the center. Through the rib 91, the rotary knob 9 can be driven by hand to turn the rotary storage wheel 2 on the axial shaft 30 of the handle body 1 inside the receiving chamber 3. When installed, the rib 91 does not project out of the cap 8. Therefore, when the palm is attached to the cap 8 and the handle body 1 is turned with the hand, the rotary knob 9 will not be turned. The cap 8 has marks 101 around the recessed back chamber 82 corresponding to the longitudinal storage grooves 22 for quick recognition of the types of bits 300 stored in the respective longitudinal storage grooves 22. The rib 92 of the rotary knob 9 is marked with an index for example an arrowhead 92. Through the indication of the arrowhead 92 and the marks 101, the user can quickly turn the rotary storage wheel 2 to move a particular longitudinal storage groove 22 into alignment with the longitudinal opening 10 of the handle body 1, permitting the desired bit to be poured out of the rotary storage wheel 2 and the handle body 1. Further, the rotary knob 9 has a coupling groove 901 inside the center coupling hole 90. The axial wheel shaft 20 of the rotary storage wheel 2 has a coupling flange 201 forced into engagement with the coupling groove 901 of the rotary knob 9.

Figure 10:
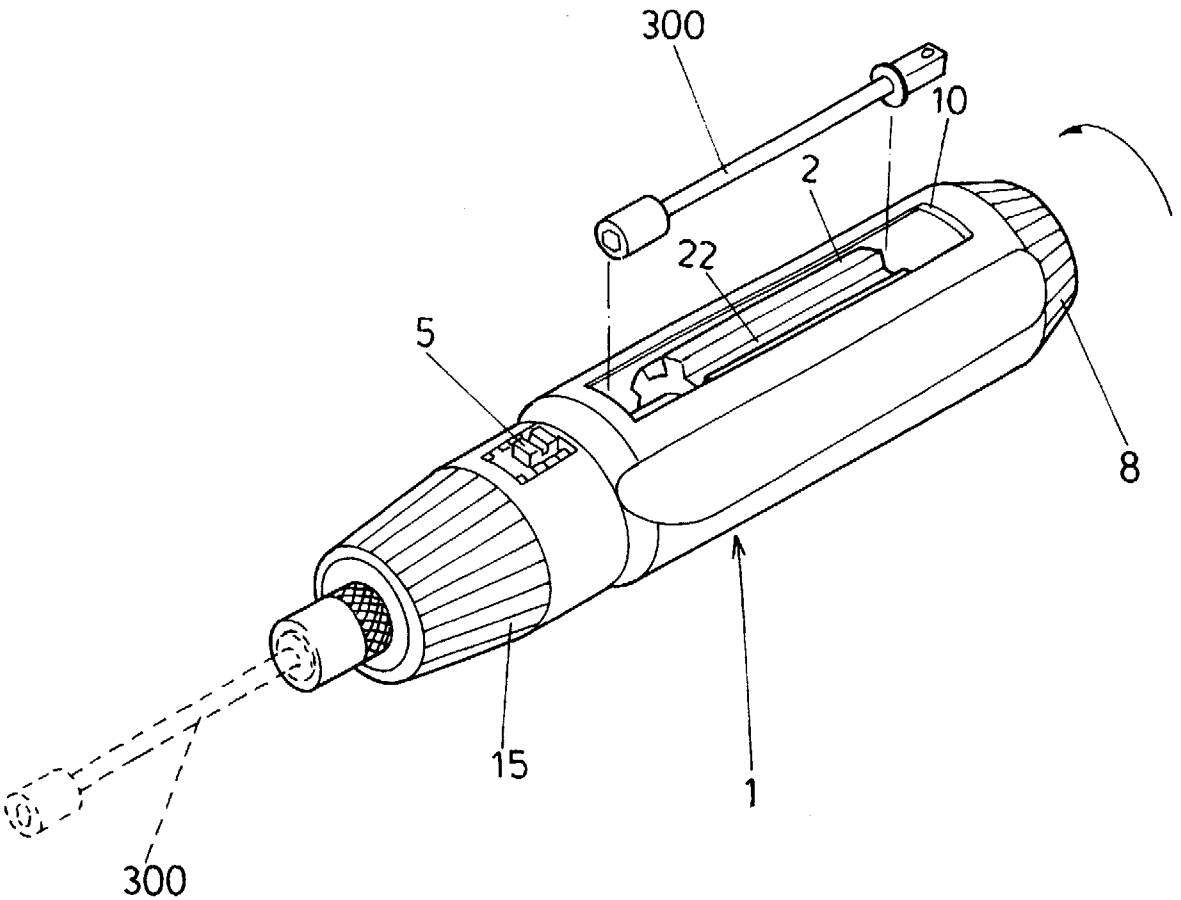
FIG. 10 shows an application example of the present invention.
Figure 11:
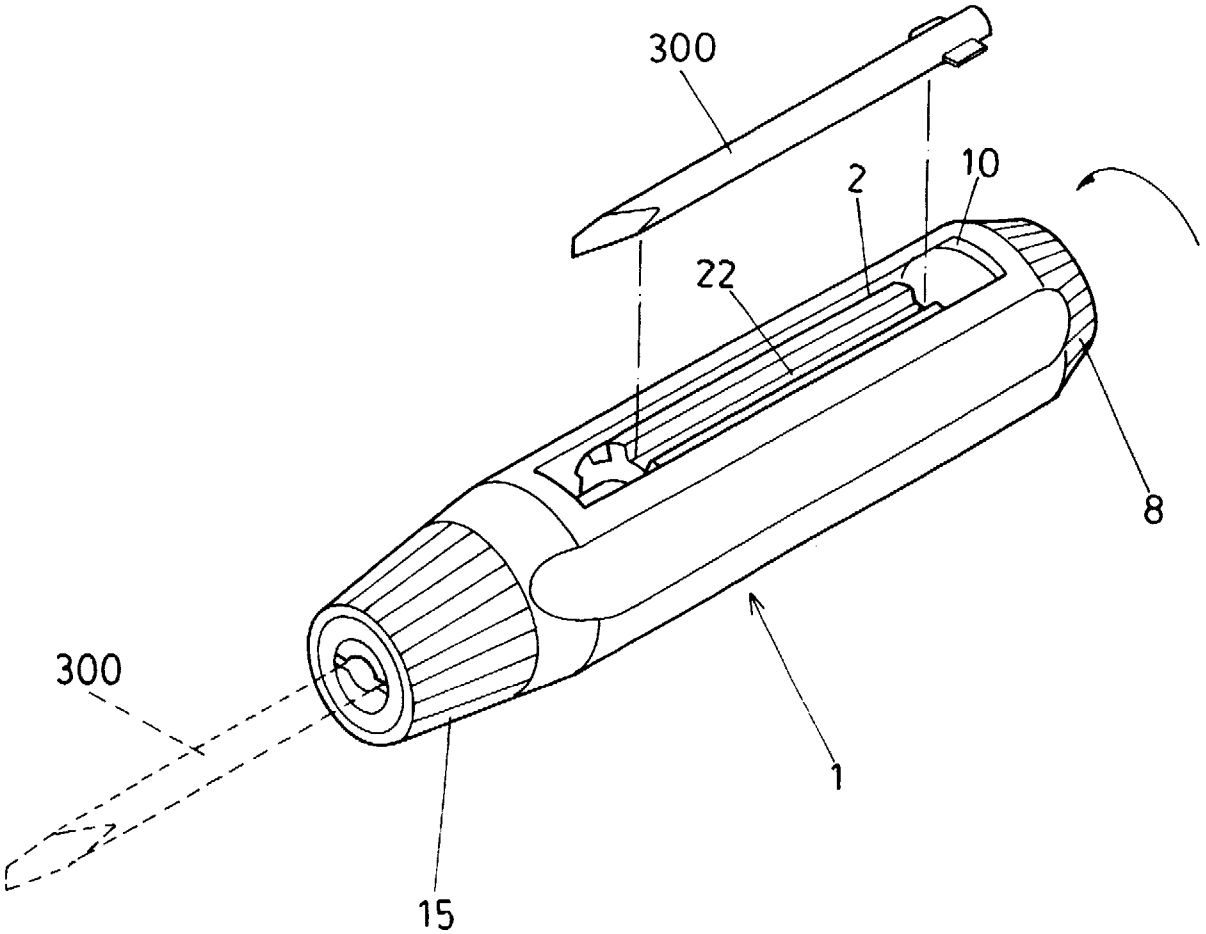
FIG. 11 shows another application example of the present invention.

Referring to FIGS. 10 and 11, when the tool handle is assembled, the rotary knob 9 is turned within the recessed back chamber 82 of the cap 8 to align the arrowhead 92 of the rib 91 with one mark of the marks 101, thus a particular bit 300 can then be put in the corresponding longitudinal storage groove 22 of the rotary storage wheel 2. When the rotary knob 9 is turned relative to the handle body 1, the cover plate 7 is forced inwards by the periphery of the longitudinal opening 10 and then moved into the inside of the receiving chamber 3, for permitting one longitudinal storage groove 22 to be moved into alignment with the longitudinal opening 10 of the handle body 1. When different tool bits 300 are respectively loaded in the longitudinal storage grooves 22 of the rotary storage wheel 2, the rotary storage wheel 2 is turned again to move the cover plate 7 into alignment with the longitudinal opening 10 of the handle body 1. When the cover plate 7 of the rotary storage wheel 2 is moved into alignment with the longitudinal opening 10 of the handle body 1, it is immediately pushed upwards by the tension springs 6 and retained in the longitudinal opening 10 of the handle body 1 in a flush manner.

Figure 12:
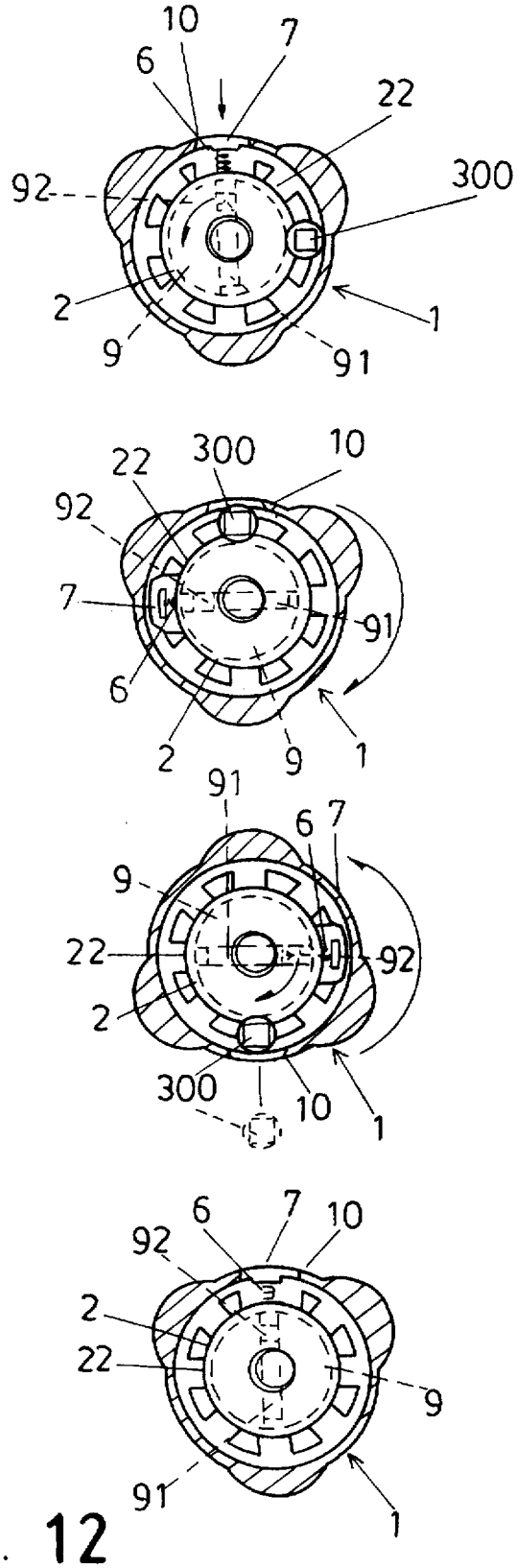
FIG. 12 are continuous drawings showing the operation procedure of picking up a particular bit from the tool handle according to the present invention; and, FIGS. 13A and 13B show two different designs of the rotary storage wheel according to the present invention.

When to pick up a particular bit 300 from the tool handle, the operation procedure is outlined hereinafter with reference to FIG. 12. The rotary knob 9 is turned with the fingers to rotate the rotary storage wheel 2 within the handle body 1. When the rotary storage wheel 2 is turned, the cover plate 7 is forced downwards by the periphery of the longitudinal opening 10 of the handle body 1. (see FIG. 12A), and moved to the inside of the handle body 1. When the cover plate 7 is moved to the inside of the handle body 1, it is turned with the rotary storage wheel 2 and moved away from the longitudinal opening 10 of the handle body 1, and therefore the longitudinal opening 10 is opened, and one longitudinal storage groove 22 of the rotary storage wheel 2 is moved into alignment with the longitudinal opening 10 of the handle body 1 (see FIG. 12B). When the desired bit 300 in one longitudinal storage groove 22 of the rotary storage wheel 2 is moved into alignment with the longitudinal opening 10 of the handle body 1 by means of the indication of the marks 101 and the arrowhead 92, the tool handle is turned through 180: to let the longitudinal opening 10 of the handle body 1 face downwards (see FIG. 12C), thus the desired bit 300 can be poured out of the rotary storage wheel 2 and the handle body 1 and attached to the coupling 4 of the handle body 1 for turning a Workpiece (see the dotted line in FIG. 10 or 11). When the selected bit 300 is installed, the rotary knob 9 is turned again to move the cover plate 7 back into the longitudinal opening 10 of the handle body 1. When the cover plate 7 is moved into the longitudinal opening 10 of the handle body 1, it is immediately forced upwards by the tension springs 6 and maintained in flush with the periphery of the handle body 1 (see FIG. 12D).

Figures 13A, 13B:
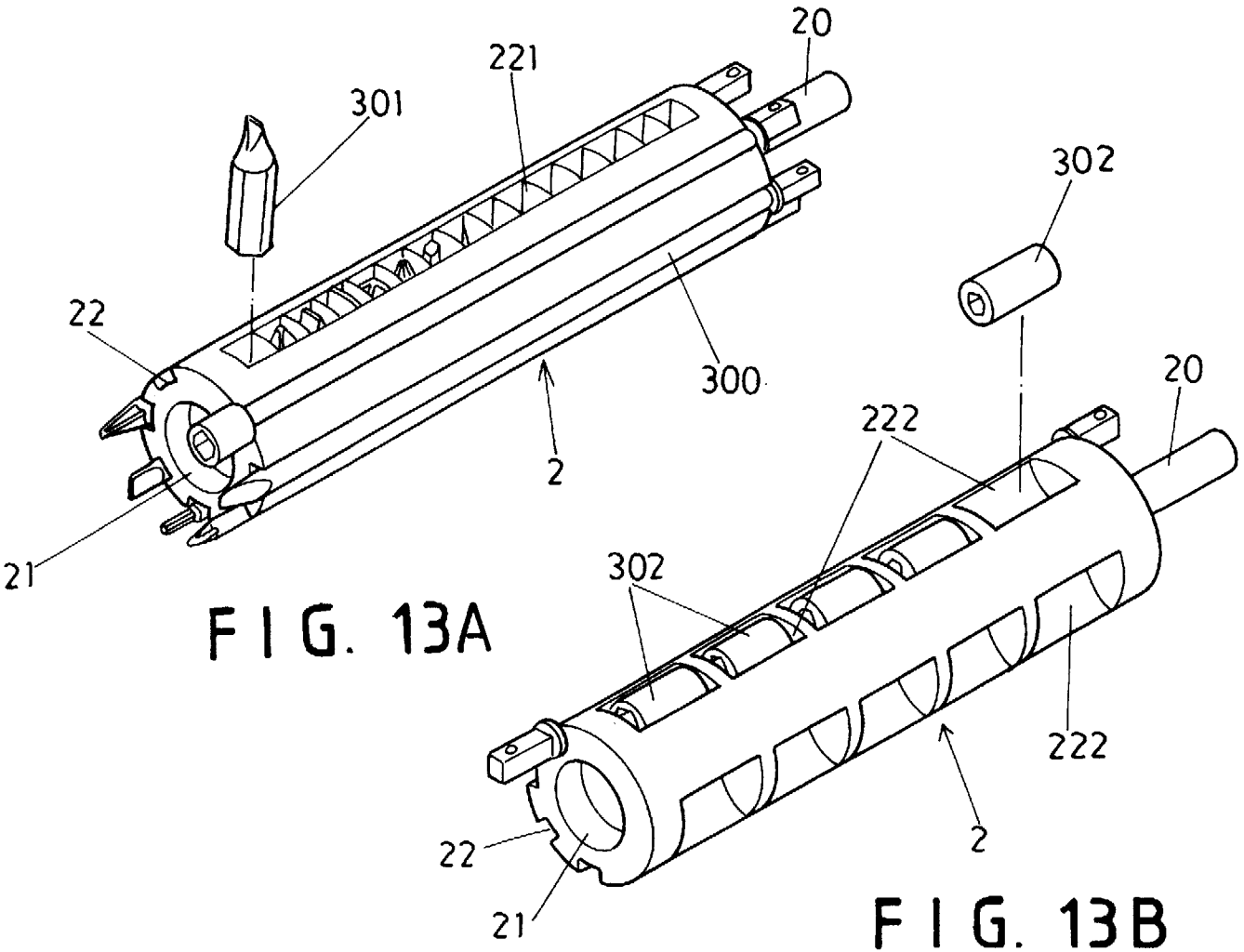

Referring to FIGS. 13A and 13B, the longitudinal storage grooves 22 of the rotary storage wheel 2 may be respectively divided into a plurality of vertical storage spaces 221 for holding screwdriver bits 301 vertically (see FIG. 13A), or horizontal storage spaces 222 for holding sockets 302 horizontally (see FIG. 13B).

The invention is naturally not limited in any sense to the particular features specified in the forgoing or to the details of the particular embodiment which has been chosen in order to illustrate the invention. Consideration can be given to all kinds of variants of the particular embodiment which has been described by way of example and of its constituent elements without thereby departing from the scope of the invention. This invention accordingly includes all the means constituting technical equivalents of the means described as well as their combinations.

I claim:

1. A tool handle comprising:

a handle body a backwardly opened receiving chamber on the inside, an axial shaft inside said receiving chamber, and a longitudinal opening through the periphery in communication with said receiving chamber, said longitudinal opening having a width gradually increased from a top side remote from said receiving chamber toward a bottom side facing said receiving chamber;

a rotary storage wheel mounted in said receiving chamber and turned on the axial shaft of said handle body, said rotary storage wheel comprising an axial wheel shaft raised from one side and extending out of said handle body, an axial coupling hole disposed at an opposite side and coupled to the axial shaft of said handle body, a plurality of longitudinal grooves spaced around the periphery, said longitudinal grooves including a longitudinal locating groove, and a plurality of longitudinal storage grooves adapted for storing tool bits and accessories, said longitudinal locating groove comprising a longitudinal row of upright stub rods and a plurality of springs respectively mounted on said upright stub rods, and an elongated cover plate supported on said springs above said longitudinal locating groove, said elongated cover plate having a substantially arched cross section fitting the longitudinal opening of said handle body, and a longitudinal row of downward stub rods respectively connected to said springs;

a cap fastened to said handle body through a screw joint to close the receiving chamber of said handle body, having a recessed back chamber, and an axial center through hole which receives the axial wheel shaft of said rotary storage wheel;

a rotary knob fastened to the axial wheel shaft of said rotary storage wheel and received in the recessed back chamber of said cap, and driven by hand to turn said rotary storage wheel, permitting said cover plate to be moved inside the receiving chamber of said handle body, and one longitudinal storage groove of said rotary storage wheel to be moved into alignment with the longitudinal opening of said handle body for loading or unloading tool bits and accessories.

* * * * *